US009429163B2

(12) United States Patent
Liu

(10) Patent No.: US 9,429,163 B2
(45) Date of Patent: Aug. 30, 2016

(54) SERIES FAN ASSEMBLING STRUCTURE

(71) Applicant: Asia Vital Components Co., Ltd., New Taipei (TW)

(72) Inventor: Wen-Hao Liu, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 484 days.

(21) Appl. No.: 14/074,453

(22) Filed: Nov. 7, 2013

(65) Prior Publication Data

US 2015/0125262 A1 May 7, 2015

(51) Int. Cl.

| | |
|---|---|
| ***F04D 19/02*** | (2006.01) |
| ***F04D 19/00*** | (2006.01) |
| ***F04D 29/52*** | (2006.01) |
| ***F04D 29/64*** | (2006.01) |
| ***F04D 29/66*** | (2006.01) |

(52) U.S. Cl.

CPC ..... *F04D 19/007* (2013.01); *F04D 29/522* (2013.01); *F04D 29/646* (2013.01); *F04D 29/668* (2013.01); *F05D 2250/311* (2013.01)

(58) Field of Classification Search

CPC .... F04D 19/007; F04D 29/52; F04D 29/522; F04D 29/64; F04D 29/646; F05D 2240/91; F05D 2250/311

See application file for complete search history.

(56) References Cited

U.S. PATENT DOCUMENTS

| | | | | |
|---|---|---|---|---|
| 7,546,998 | B2 * | 6/2009 | Chen | F04D 19/007 248/674 |
| 7,985,056 | B2 * | 7/2011 | Chou | F04D 19/007 361/695 |
| 8,197,198 | B2 * | 6/2012 | Miyabara | F04D 19/007 415/199.5 |
| 2013/0058781 | A1 * | 3/2013 | Fu | H05K 7/20581 415/220 |

* cited by examiner

*Primary Examiner* — Ninh H Nguyen

(57) ABSTRACT

A series fan assembling structure includes a connection assembly, a first fan and a second fan. The connection assembly has a first connection member having a first end face and a second end face opposite to the first end face. A second connection member is disposed at an upper end of the first connection member to outward horizontally extend from the first end face. A third connection member is disposed at a lower end of the first connection member to outward horizontally extend from the second end face. A passage is formed at the centers of the first and second end faces. The first fan is mated with the first end face of the first connection member and horizontally connected with the second connection member. The second fan is mated with the second end face of the first connection member and horizontally connected with the third connection member.

8 Claims, 10 Drawing Sheets

SERIES FAN ASSEMBLING STRUCTURE

BACKGROUND OF THE INVENTION

1. Field of the Invention

The present invention relates generally to a series fan assembling structure, and more particularly to a series fan assembling structure, which can greatly reduce the vibration of the series fan.

2. Description of the Related Art

Along with the continuous advance of sciences and technologies, the reliance of peoples on various electronic apparatuses has more and more increased. In operation, the internal components of the electronic products (such as computers and laptops) will generate high heat. The heat must be dissipated to outer side of the electronic products in time. Otherwise, the problem of overheating will take place. Therefore, most of the electronic products are provided with fans disposed therein for keeping the electronic products working at an operation temperature within a range.

Please refer to FIGS. 1A and 1B. The fan frames 10 of the current series fan 1 have the same size. The fan frames 10 are assembled with a fan impeller 11, a motor (not shown), etc. to form the fan. In operation, according to the design principle of the motor torque operation, the fan frame 11 will inevitably vibrate. Especially, with respect to a series fan, the fan frames 10 are serially connected simply by means of the latch structures 12 between the fan frames 10 along the central shaft of the fan. Therefore, the vibration state of the fan cannot be changed. As a result, when the fan impellers 11 inside the fan frames 10 operate and rotate at the same time, under the inter-affection of the vibration frequency of the fan impellers 11, the two fan frames 10 will severely resonate under resonation effect. The resonation will be directly transmitted outward form the fan frames 10. The hard disc (such as the hard disc in a server) of the mainframe system of an electronic product is quite sensitive to vibration. However, the conventional one-piece fan frame 10 can hardly reduce the vibration. In some more serious cases, the vibration of the motor and the fan impeller 11 will even interfere with the normal work of other electronic components. This will lead to deterioration of the performance of the system. Moreover, the resonation is always accompanied by loud noise.

According to the above, the conventional device has the following shortcomings:

1. The vibration of the fan can be hardly effectively reduced.
2. The vibration of the fan will make loud noise.
3. The reading efficiency of the hard disc of the system is lowered.

SUMMARY OF THE INVENTION

It is therefore a primary object of the present invention to provide a series fan assembling structure, which can greatly reduce the vibration of the series fan.

It is a further object of the present invention to provide the above series fan assembling structure, which can lower the noise caused by the vibration of the series fan.

To achieve the above and other objects, the series fan assembling structure of the present invention includes a connection assembly, a first fan and a second fan. The connection assembly has a first connection member, a second connection member and a third connection member. The first connection member has a first end face and a second end face opposite to the first end face. The second connection member is disposed at an upper end of the first connection member to outward horizontally extend from the first end face. The third connection member is disposed at a lower end of the first connection member to outward horizontally extend from the second end face. The second connection member and the third connection member horizontally extend in reverse directions. A passage is formed at centers of the first and second end faces.

The first fan is mated with the first end face of the first connection member. The first fan has a first fan frame and a first flow passage passing through the first fan frame. The first fan frame is connected with the second connection member in a horizontal position. The first flow passage communicates with the passage.

The second fan is mated with the second end face of the first connection member. The second fan has a second fan frame and a second flow passage passing through the second fan frame. The second fan frame is connected with the third connection member in a horizontal position. The second flow passage communicates with the passage.

The first fan is mated with the first end face and connected with the second connection member and the second fan is mated with the second end face and connected with the third connection member. Accordingly, the connection assembly is securely assembled with the first and second fans to greatly reduce the vibration of the fan in operation and lower the noise caused by the vibration. In addition, the reading efficiency of the hard disc of the system is enhanced.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
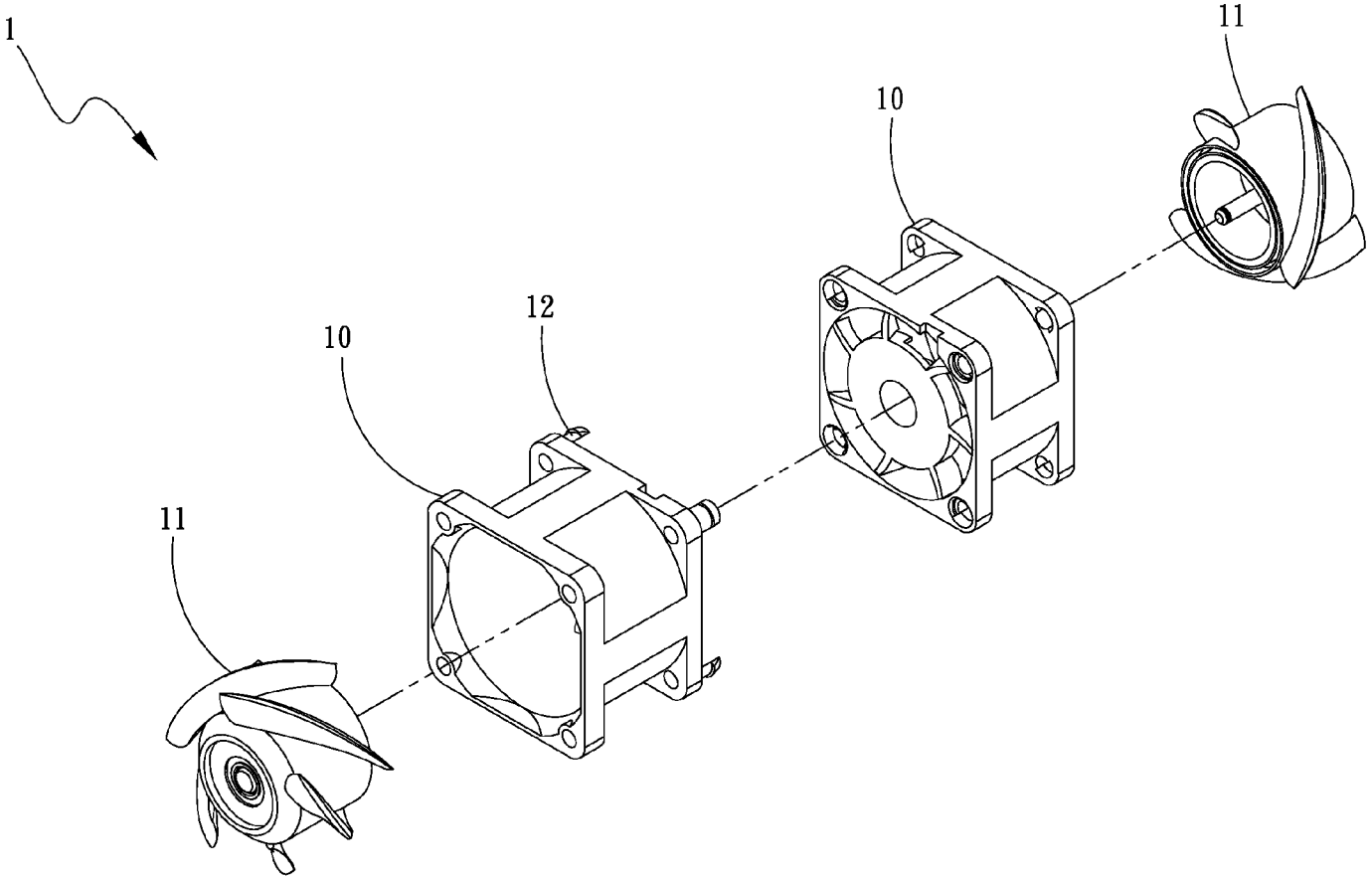
(PRIOR ART) Fig. 1A
FIG. 1A is a perspective exploded view of a conventional series fan assembling structure.
Figure 1B:
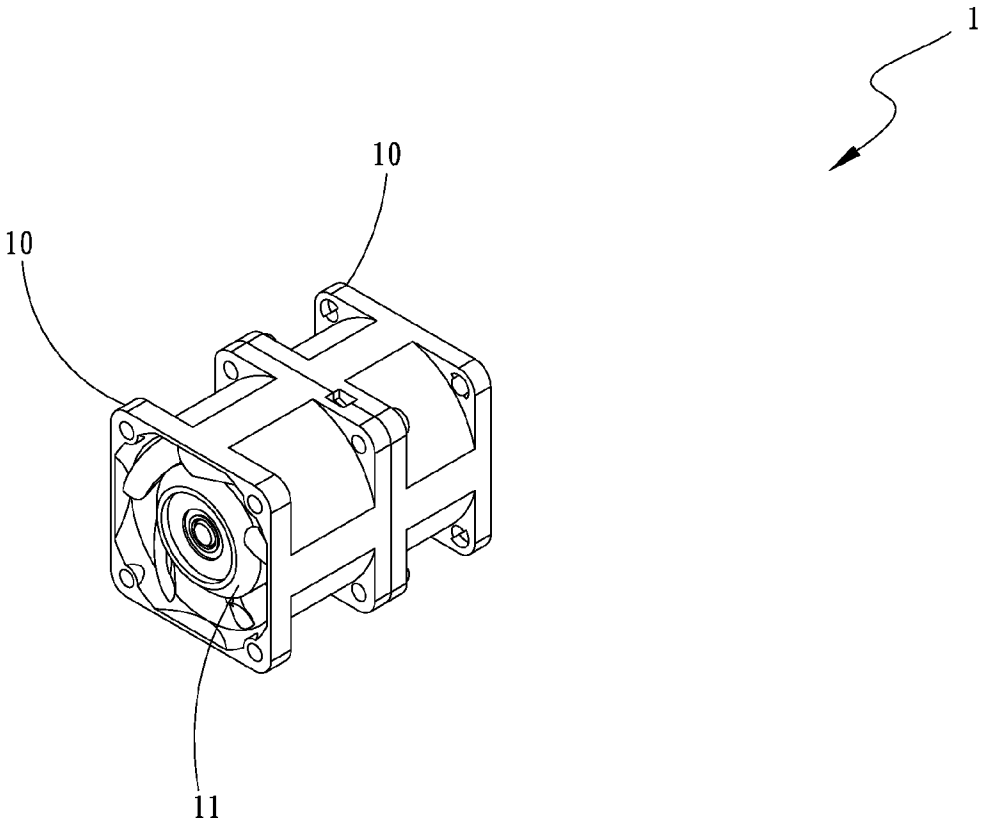
(PRIOR ART) Fig. 1B
FIG. 1B is a perspective assembled view of the conventional series fan assembling structure.
Figure 2A:
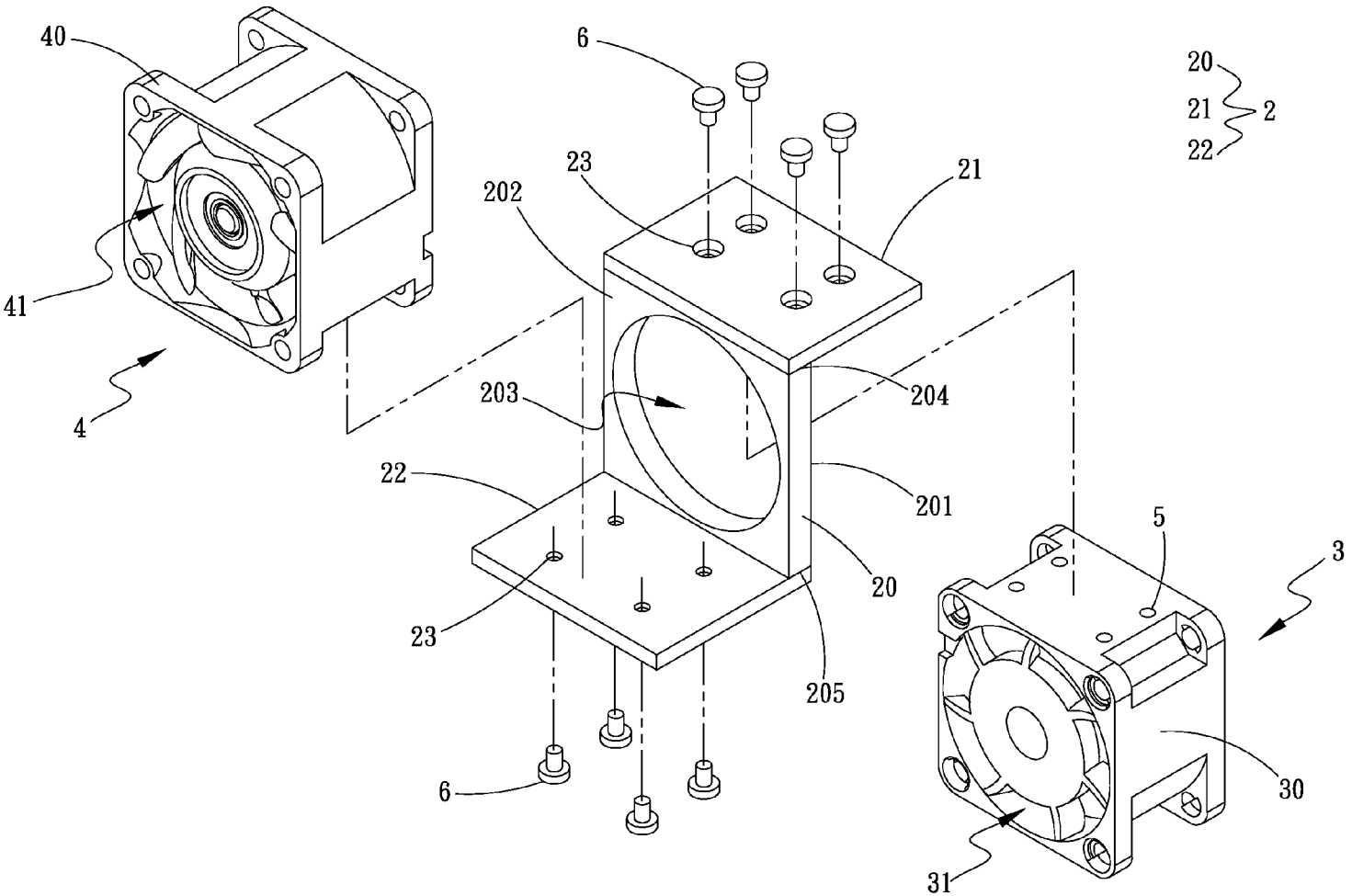
FIG. 2A is a perspective exploded view of a first embodiment of the series fan assembling structure of the present invention.
Figure 2B:
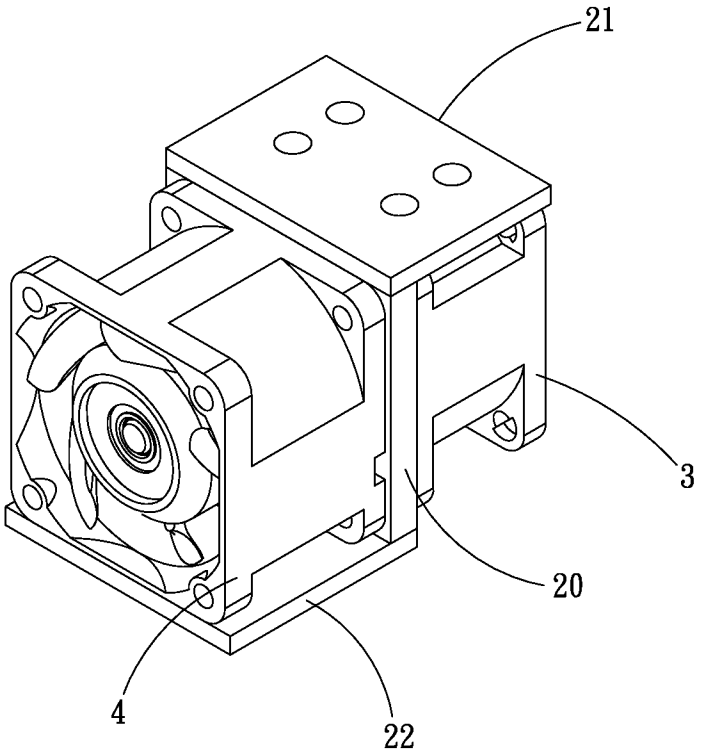
FIG. 2B is a perspective assembled view of the first embodiment of the series fan assembling structure of the present invention.

Please refer to FIGS. 2A and 2B. FIG. 2A is a perspective exploded view of a first embodiment of the series fan assembling structure of the present invention. FIG. 2B is a perspective assembled view of the first embodiment of the series fan assembling structure of the present invention. According to the first embodiment, the series fan assembling structure of the present invention includes a connection assembly 2, a first fan 3 and a second fan 4. The connection assembly 2 has a first connection member 20. The first connection member 20 has a first end face 201 and a second end face 202 opposite to the first end face 201. A second connection member 21 is disposed at an upper end 204 of the first connection member 20 to outward horizontally extend from the first end face 201. A third connection member 22 is disposed at a lower end 205 of the first connection member 20 to outward horizontally extend from the second end face 202. The second connection member 21 and the third connection member 22 horizontally extend in reverse directions. A passage 203 is formed at the centers of the first and second end faces 201, 202.

The second and third connection members 21, 22 are formed with multiple perforations 23. The first and second fans 3, 4 are formed with multiple through holes 5 corresponding to the perforations 23. Multiple fastening members 6 are passed through the perforations 23 and the through holes 5. In this embodiment, the first and second fans 3, 4 are assembled with the second and third connection members 21, 22 by means of locking. In practice, the first and second fans 3, 4 can be assembled with the second and third connection members 21, 22 by any other measure that can securely connect the first and second fans 3, 4 with the second and third connection members 21, 22, for example, by means of engagement, insertion, adhesion, latching or slide rail. This is not limited.

The first fan 3 is mated with the first end face 201 of the first connection member 20. The first fan 3 has a first fan frame 30 and a first flow passage 31 passing through the first fan frame 30. The first fan frame 30 is connected with the second connection member 21 in a horizontal position. The first flow passage 31 communicates with the passage 203.

The second fan 4 is mated with the second end face 202 of the first connection member 20. The second fan 4 has a second fan frame 40 and a second flow passage 41 passing through the second fan frame 40. The second fan frame 40 is connected with the third connection member 22 in a horizontal position. The second flow passage 41 communicates with the passage 203.

According to the assembling structure of the present invention, the first fan frame 30 of the first fan 3 is connected with the second connection member 21 in a horizontal position and mated with the first end face 201. The second fan frame 40 of the second fan 4 is connected with the third connection member 22 in a horizontal position and mated with the second end face 202. Accordingly, the connection assembly 2 is securely assembled with the first and second fans 3, 4. In this case, when the series fan operates, the vibration frequencies of the fans are unified or damped by each other to greatly reduce the vibration and noise. Therefore, the present invention solves the problem of the conventional series fan that the first and second fans are simply directly assembled with each other and the vibration frequency cannot be changed or damped. In addition, the reading efficiency of the hard disc of the system is enhanced.

Figure 3A:
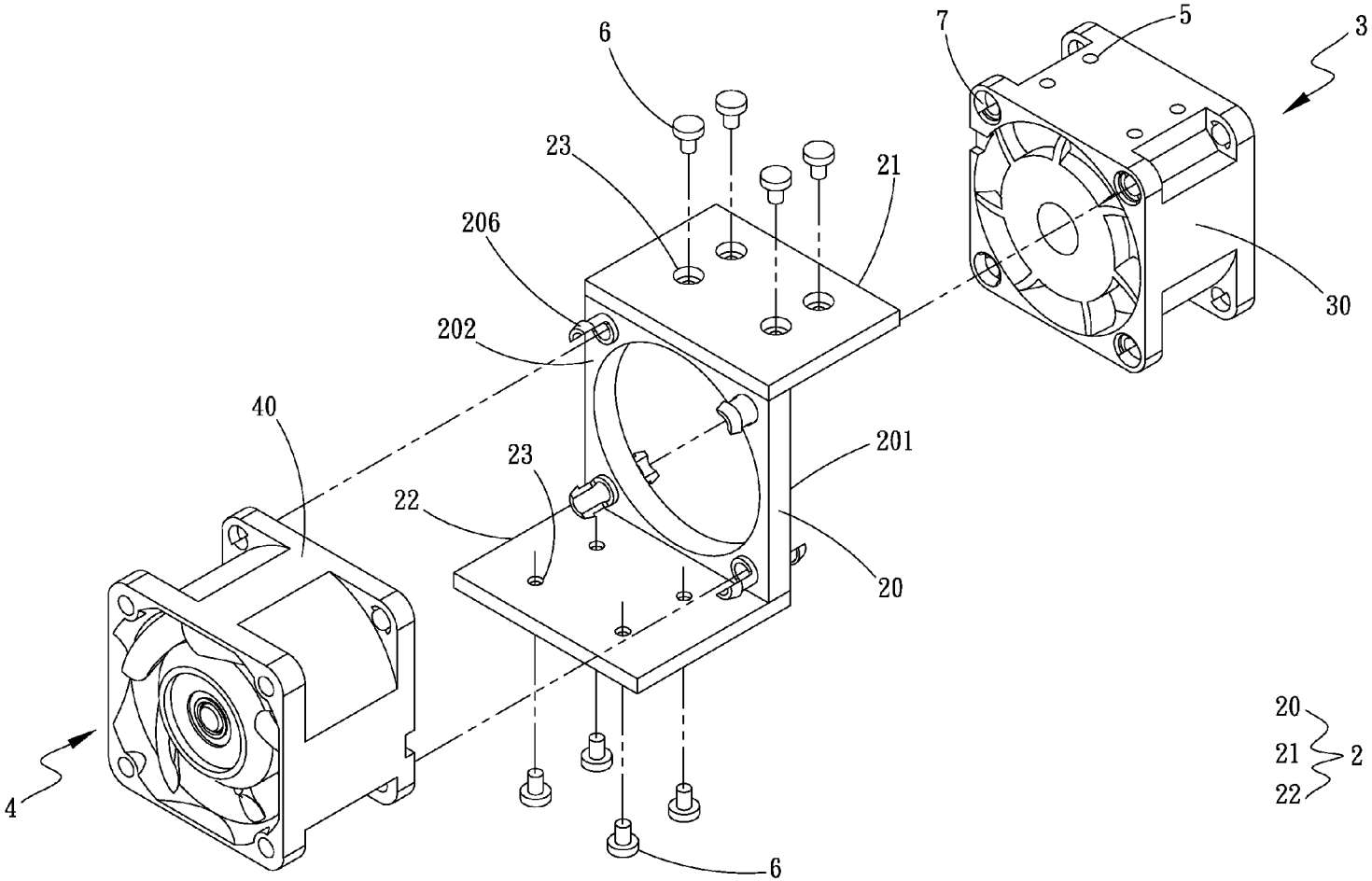
FIG. 3A is a perspective exploded view of a second embodiment of the series fan assembling structure of the present invention.
Figure 3B:
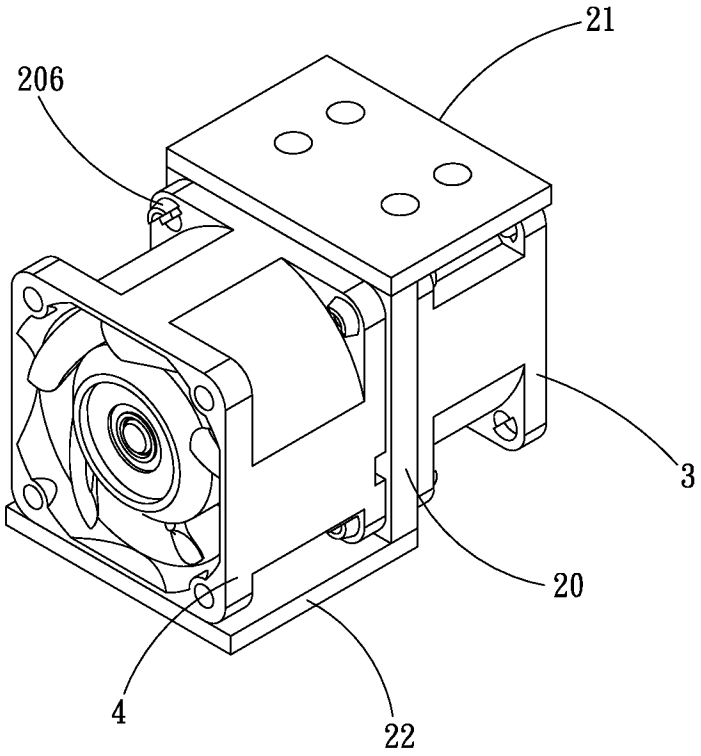
FIG. 3B is a perspective assembled view of the second embodiment of the series fan assembling structure of the present invention.

Please now refer to FIGS. 3A and 3B. FIG. 3A is a perspective exploded view of a second embodiment of the series fan assembling structure of the present invention. FIG. 3B is a perspective assembled view of the second embodiment of the series fan assembling structure of the present invention. The second embodiment is partially identical to the first embodiment in component and relationship between the components and thus will not be repeatedly described hereinafter. The second embodiment is mainly different from the first embodiment in that the first and second end faces 201, 202 of the first connection member 20 have multiple assembling sections 206. The four corners of the fan frames of the first and second fans 3, 4 are formed with multiple connection sections 7 corresponding to the assembling sections 206 for assembling with the assembling sections 206. In this embodiment, the first and second fans 3, 4 are assembled with the first and second end faces 201, 202 by means of engagement. In practice, the first and second fans 3, 4 can be assembled with the first and second end faces 201, 202 by any other measure that can securely connect the first and second fans 3, 4 with the first and second end faces 201, 202, for example, by means of locking, insertion, adhesion, latching or slide rail. This is not limited.

In this embodiment, the assembling sections 206 are, but not limited to, posts for illustration purposes only. In practice, the assembling sections 206 can be any other means that can securely connect the first and second fans 3, 4 with the first connection member 20, for example, holes, sockets or mortises.

In this embodiment, the connection sections 7 are, but not limited to, holes for illustration purposes only. In practice, the connection sections 7 can be any other means that can securely connect the first and second fans 3, 4 with the first connection member 20, for example, sockets, mortises or posts.

According to the assembling structure of the present invention, the assembling sections 206 of the first and second end faces 201, 202 of the first connection member 20 are correspondingly connected with the connection sections 7 of the first and second fans 3, 4 to not only locate the first and second fans 3, 4, but also more tightly connect the connection assembly 2 with the first and second fans 3, 4. In this case, when the series fan operates, the vibration frequencies of the fans are unified to greatly reduce the vibration and noise. In addition, the reading efficiency of the hard disc of the system is enhanced.

Figure 4A:
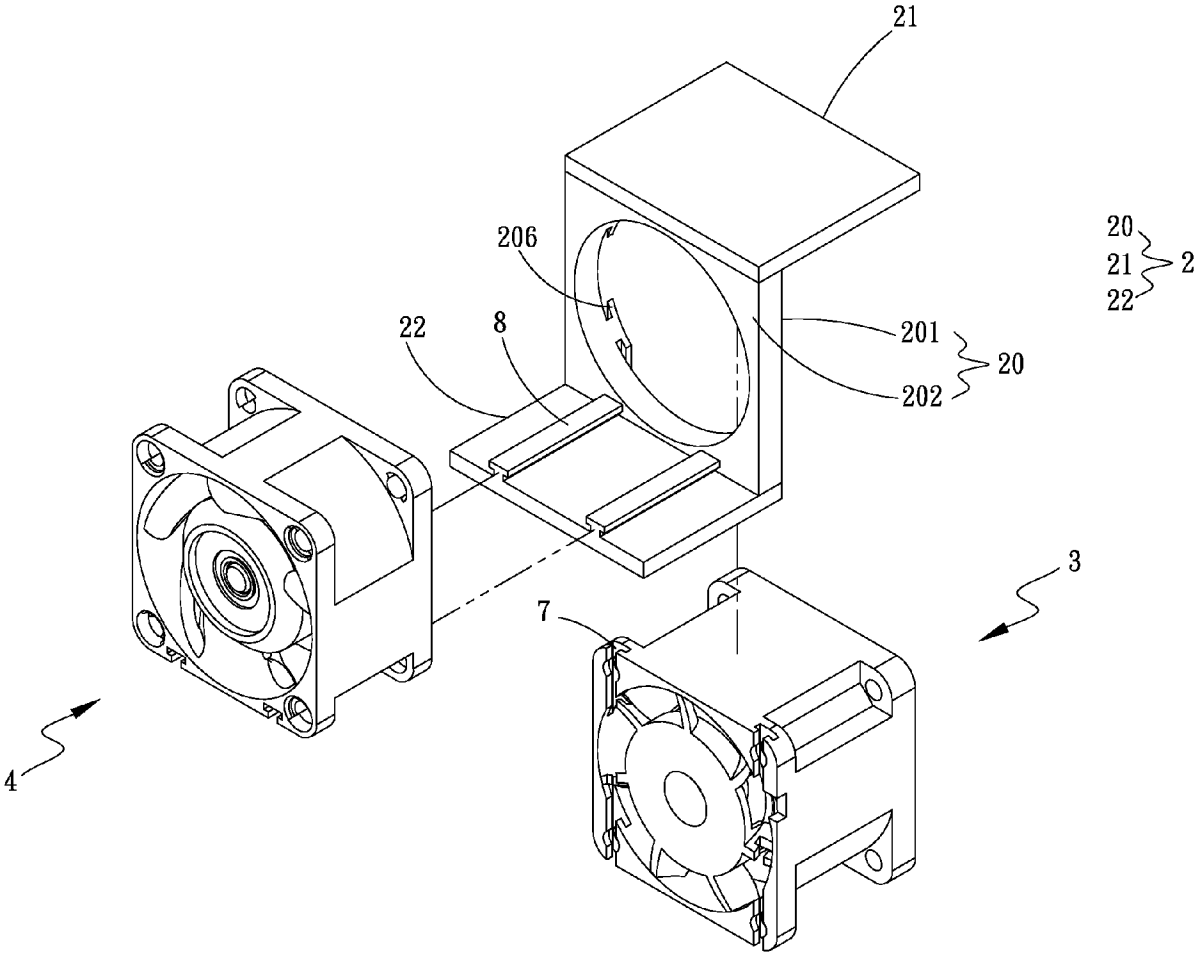
FIG. 4A is a perspective exploded view of a third embodiment of the series fan assembling structure of the present invention.
Figure 4B:
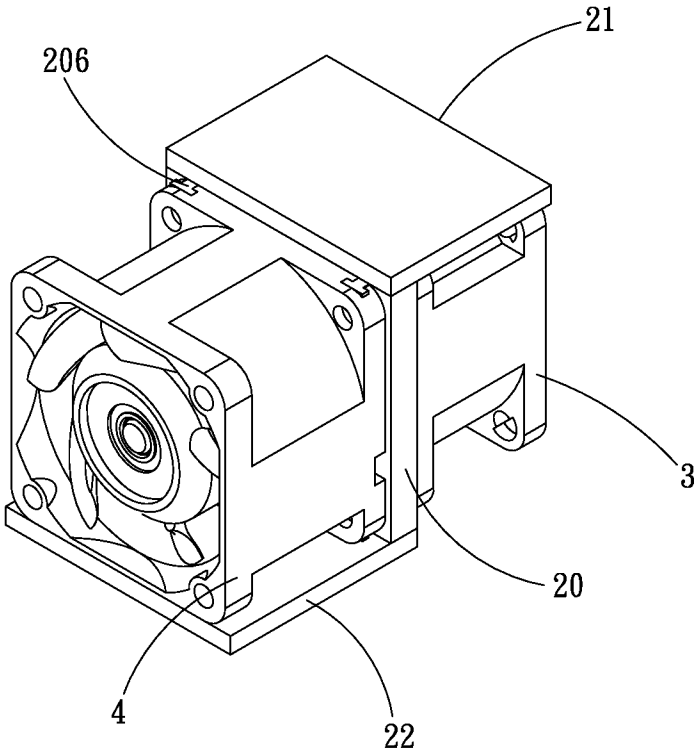
FIG. 4B is a perspective assembled view of the third embodiment of the series fan assembling structure of the present invention.
Figure 5:
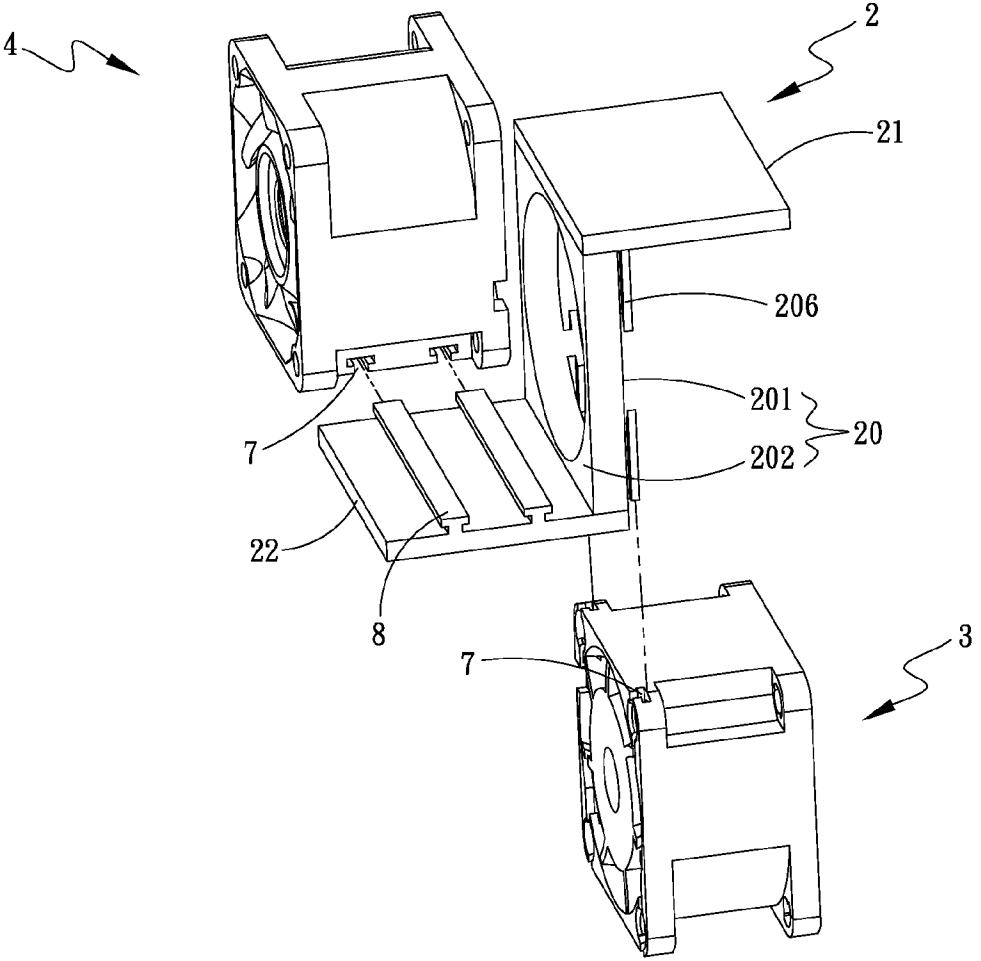
FIG. 5 is a perspective exploded view of a fourth embodiment of the series fan assembling structure of the present invention.

Please now refer to FIGS. 4A, 4B and 5. FIG. 4A is a perspective exploded view of a third embodiment of the series fan assembling structure of the present invention. FIG. 4B is a perspective assembled view of the third embodiment of the series fan assembling structure of the present invention. FIG. 5 is a perspective exploded view of a fourth embodiment of the series fan assembling structure of the present invention. The third and fourth embodiments are partially identical to the first embodiment in component and relationship between the components and thus will not be repeatedly described hereinafter. The third and fourth embodiments are mainly different from the first embodiment in that at least one rail 8 is disposed on the second connection member 21 or the third connection member 22 in any position instead of the perforations 23 (as shown in FIG. 3A). The first and second end faces 201, 202 of the first connection member 20 have multiple assembling sections 206. The first and second fans 3, 4 have multiple connection sections 7 for correspondingly assembling with the assembling sections 206. In this embodiment, the rail 8 and the assembling sections 206 and the connection sections 7 together form a slide rail mechanism for tightly connecting the first and second fans 3, 4 with the connection assembly 2. The rail 8 can be disposed on the second connection member 21 or the third connection member 22 in an axial direction (as shown in FIG. 4A) or a non-axial direction (as shown in FIG. 5). In both cases, when the series fan operates, the vibration frequencies of the fans are unified to greatly reduce the vibration and noise. In addition, the reading efficiency of the hard disc of the system is enhanced.

Figure 6:
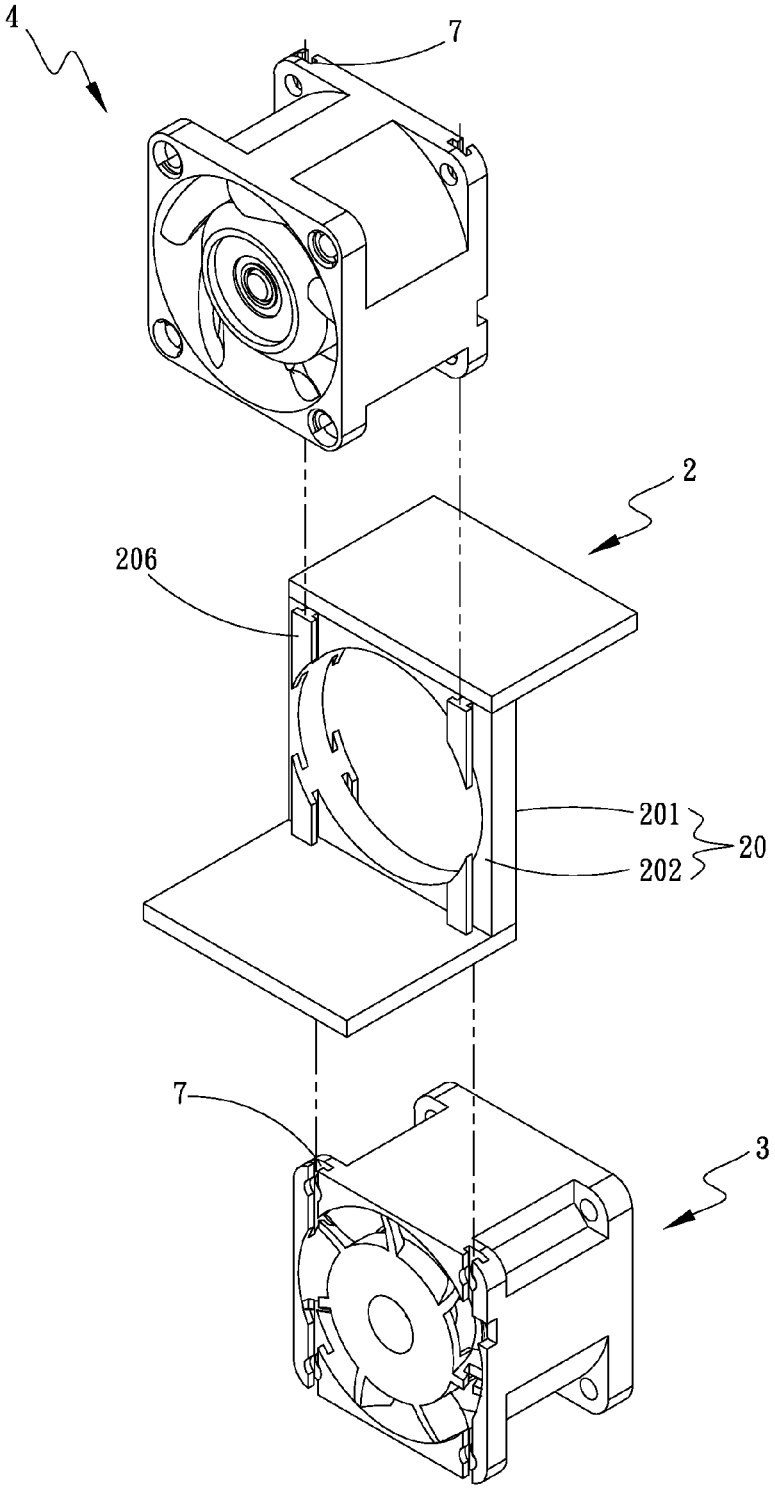
FIG. 6 is a perspective exploded view of a fifth embodiment of the series fan assembling structure of the present invention.

Please now refer to FIG. 6, which is a perspective exploded view of a fifth embodiment of the series fan assembling structure of the present invention. The fifth embodiment is partially identical to the first embodiment in component and relationship between the components and thus will not be repeatedly described hereinafter. The fifth embodiment is mainly different from the first embodiment in that the first and second end faces 201, 202 of the first connection member 20 have assembling sections 206 and the first and second fans 3, 4 are formed with connection sections 7 correspondingly tightly connected with the assembling sections 206. That is, the first and second fans 3, 4 are correspondingly assembled with the first connection member 20 from two opposite side of the connection assembly 2 to form the series fan assembling structure.

In conclusion, in comparison with the conventional series fan, the present invention has the following advantages:

1. The vibration of the fan is greatly reduced and damped.
2. The noise caused by the vibration of the fan is lowered.
3. The reading efficiency of the hard disc of the system is enhanced.

The present invention has been described with the above embodiments thereof and it is understood that many changes and modifications in the above embodiments can be carried out without departing from the scope and the spirit of the invention that is intended to be limited only by the appended claims.

What is claimed is:

1. A series fan assembling structure comprising:

a connection assembly having a first connection member, a second connection member and a third connection member, the first connection member having a first end face and a second end face opposite to the first end face, the second connection member being disposed at an upper end of the first connection member to outward horizontally extend from the first end face, the third connection member being disposed at a lower end of the first connection member to outward horizontally extend from the second end face, the second connection member and the third connection member horizontally extending in reverse directions, a passage being formed at centers of the first and second end faces;

a first fan mated with the first end face of the first connection member, the first fan having a first fan frame and a first flow passage passing through the first fan frame, the first fan frame being connected with the second connection member in a horizontal position, the first flow passage communicating with the passage; and a second fan mated with the second end face of the first connection member, the second fan having a second fan frame and a second flow passage passing through the second fan frame, the second fan frame being connected with the third connection member in a horizontal position, the second flow passage communicating with the passage.

2. The series fan assembling structure as claimed in claim 1, wherein the second and third connection members are formed with multiple perforations and the first and second fans are formed with multiple through holes corresponding to the perforations, multiple fastening members being passed through the perforations and the through holes.

3. The series fan assembling structure as claimed in claim 2, wherein the first and second fans are assembled with the second and third connection members by means of engagement, locking, insertion, adhesion, latching or slide rail.

4. The series fan assembling structure as claimed in claim 1, wherein the first and second end faces of the first connection member have multiple assembling sections and the first and second fans have multiple connection sections corresponding to the assembling sections for assembling with the assembling sections.

5. The series fan assembling structure as claimed in claim 4, wherein the first and second fans are assembled with the second and third connection members by means of engagement, locking, insertion, adhesion, latching or slide rail.

6. The series fan assembling structure as claimed in claim 5, wherein the assembling sections are holes, sockets, mortises or posts.

7. The series fan assembling structure as claimed in claim 5, wherein the connection sections are holes, sockets, mortises or posts.

8. The series fan assembling structure as claimed in claim 4, wherein at least one rail is disposed on the second connection member or the third connection member in any position for correspondingly assembling with the connection sections.

* * * * *